United States Patent [19]

Klotz

[11] 4,356,586

[45] Nov. 2, 1982

[54] SPONGE MOP

[76] Inventor: Warren C. Klotz, 29 Huntington Dr., Belleville, Ill. 62223

[21] Appl. No.: 253,774

[22] Filed: Apr. 13, 1981

[51] Int. Cl.[3] ..... A47L 13/146

[52] U.S. Cl. ..... 15/119 A; 15/151; 15/244 R

[58] Field of Search ..... 15/116 A, 119 A, 118, 15/146, 151, 244 R, 244 A

[56] References Cited

U.S. PATENT DOCUMENTS

| | | | |
|---|---|---|---|
| 1,311,657 | 7/1919 | Levins | 15/146 |
| 1,539,857 | 6/1925 | Martin . | |
| 2,213,732 | 9/1940 | Goldberg | 15/241 |
| 2,221,557 | 11/1940 | Rogers | 15/119 |
| 2,235,264 | 3/1941 | Rogers | 15/119 |
| 2,406,950 | 9/1946 | Jackson | 15/119 |
| 2,984,851 | 5/1961 | Thompson et al. | 15/119 |
| 2,994,096 | 8/1961 | Vaughn | 15/119 A |
| 3,030,648 | 4/1962 | Greenleaf | 15/119 A |
| 4,114,321 | 9/1978 | Jarvis et al. | 15/146 X |

FOREIGN PATENT DOCUMENTS

| | | | |
|---|---|---|---|
| 7081 | of 1902 | United Kingdom | 15/146 |
| 223447 | 10/1924 | United Kingdom | 15/146 |

*Primary Examiner*—Edward L. Roberts

*Attorney, Agent, or Firm*—Senniger, Powers, Leavitt and Roedel

[57] ABSTRACT

A sponge mop having a mop head which will accept an ordinary household sponge as a replacement sponge and which has an improved wringer. The mop head comprises front and back jaws which are slidably interengageable with one another to compressively clamp a sponge between them. The wringer is mounted on the mop head for sliding movement relative to the mop head between a retracted position in which it is disposed to permit mopping and an extended position from which it may be pivoted to a wringing position to wring out the sponge.

20 Claims, 11 Drawing Figures

SPONGE MOP

BACKGROUND OF THE INVENTION

This invention relates to sponge mops, and more particularly to sponge mops in which the sponge is replaceable. The invention further relates to wringers for sponge mops.

Most sponge mops are designed for replacement of the sponge when it becomes worn or otherwise unserviceable. However, sponge replacement is typically relatively expensive, because the mops are designed for the sponge to be sold in an assembly, such as a sponge secured to a backing plate. In some mops the entire mop head must be replaced along with the sponge. This invention is concerned with a sponge mop which utilizes for a replacement sponge an ordinary household sponge, without a backing plate or the like. U.S. Pat. Nos. 1,539,857, 2,213,732, and 2,235,264 may be considered relevant to this aspect of the invention.

To squeeze water (and dirt) out of the sponge, most sponge mops are provided with a wringer, typically comprised of a squeeze plate hinged at the rear of the mop head. A lever arm is attached to the squeeze plate for pivoting the plate to wring out the sponge, the arm being spring-biased against the mop handle when the wringer is not in use. Wringing out the sponge requires rotation of the lever arm through approximately 220° where the mop is of the type in which the handle is inclined 45° from vertical relative to the mop head, which is a typical type. This long lever arm throw is awkward. The invention is concerned with providing a sponge mop wringer mechanism in which the rotation of the lever arm to effect squeezing of the sponge is considerably less than the typical 220°, providing a more convenient wringer. U.S. Pat. Nos. 2,213,732, 2,221,557, and 2,984,851 may be considered relevant to this aspect of the invention.

SUMMARY OF THE INVENTION

Among the several objects of this invention may be noted the provision of an improved sponge mop; the provision of a sponge mop in which an ordinary household sponge may be used as a replacement sponge; the provision of such a sponge mop in which the sponge may be readily clamped in place in the mop head; the provision of a sponge mop having an improved wringing mechanism; the provision of such a mop wherein the angle through which the wringing mechanism must be rotated to effect wringing of the sponge is minimized; the provision of such a mop in which the wringing mechanism is out-of-the-way when not in use.

Briefly summarized, the invention involves a mop comprising a mop head having opposing front and back jaws for clamping a sponge or the like therebetween. Each jaw has an upper portion adapted to overlie the sponge and a depending clamping portion engageable with a respective front or back of the sponge. The upper portions of the jaws are formed for sliding interengagement with one another to permit the jaws to be slidably moved between an open position in which their clamping portions are spaced relatively far apart for placement of a sponge therebetween and a closed position in which the clamping portions are closer together for clamping the sponge therebetween. Means are provided for holding the two jaws in the closed position with the sponge clamped therebetween. The mop has a wringer for wringing the sponge comprising a squeeze plate extending in side-to-side direction with respect to the mop head and a lever arm on the squeeze plate. The squeeze plate and lever arm are mounted on the mop head for sliding movement of the squeeze plate from a retracted position in which it is disposed to permit mopping, to an extended position, the mounting permitting pivoting movement of the squeeze plate, via the lever arm, about an axis extending in side-to-side direction with respect to the mop head from the extended position to a wringing position in which the squeeze plate squeezes the sponge to wring it out.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
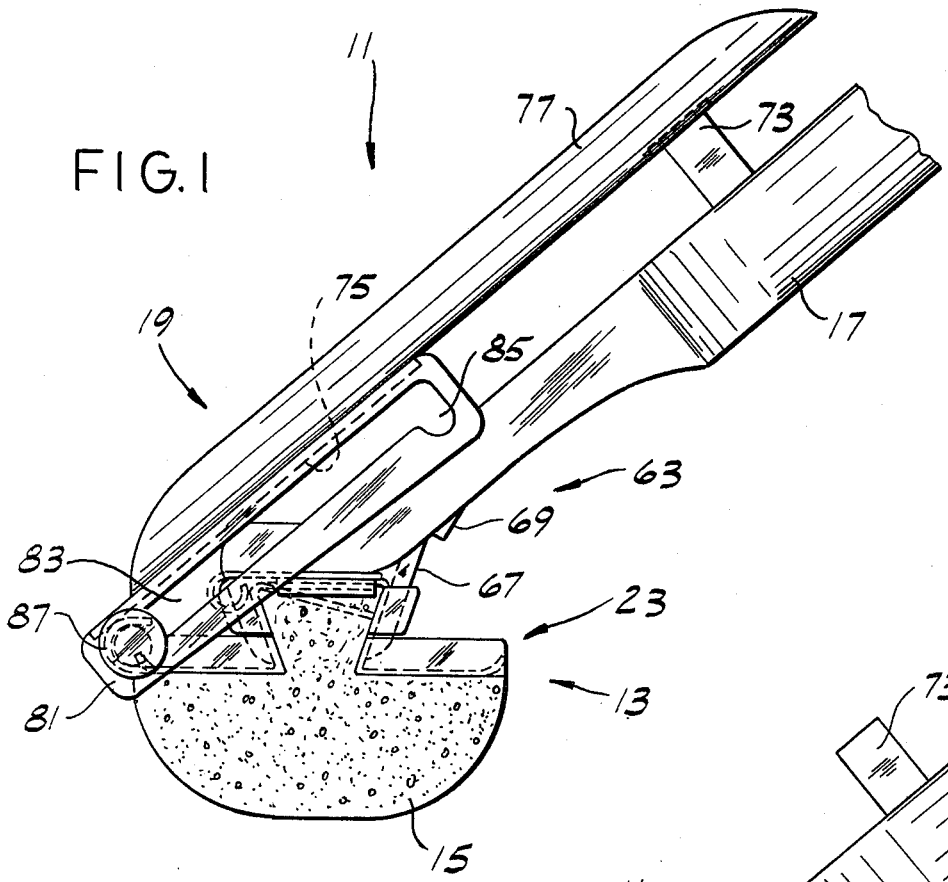
FIG. 1 is a side elevation of a sponge mop of the present invention, shown with its wringer in a retracted position.

Referring first to FIGS. 1-8 of the drawings, a sponge mop of the present invention, designated in its entirety by the numeral 11, generally comprises a mop head 13 for holding an ordinary rectangular household sponge 15, a mop handle 17 attached to the mop head, and a wringer 19 for the sponge.

Figures 5, 6, 7, 8:
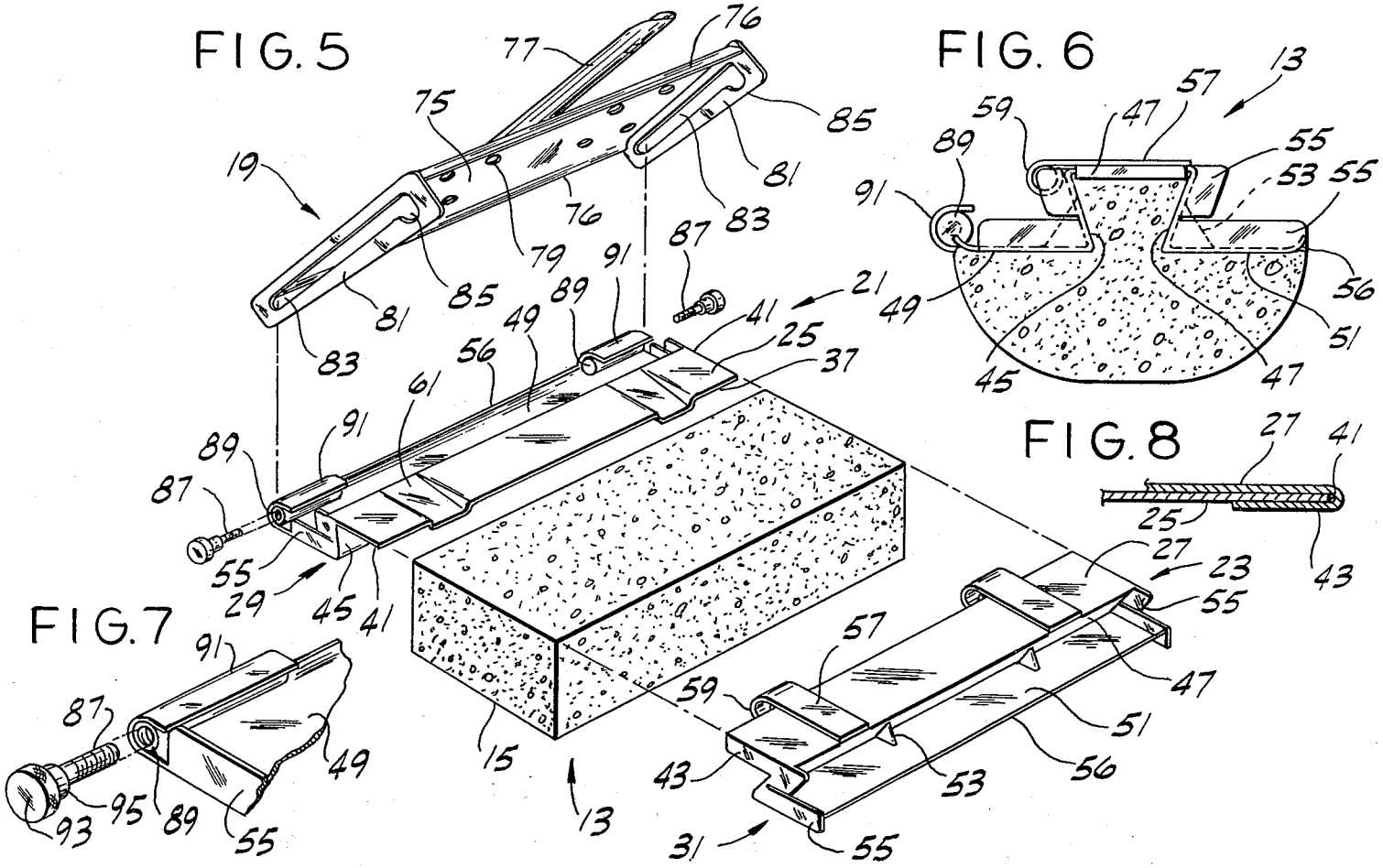
FIG. 5 is an assembly drawing of the mop head and wringer.
FIG. 6 is a side elevation of two jaws of the mop head assembled together to clamp a sponge therebetween.
FIG. 7 is a perspective of a pivot pin for the wringer.
FIG. 8 is an enlarged vertical section taken along line 8—8 of FIG. 3.

Mop head 13, as shown in FIG. 5, includes a front jaw 21 and an opposing rear or back jaw 23, each being formed of sheet metal and having a generally Z-shaped cross-section. Front and rear jaws 21 and 23 have upper portions designated 25 and 27, respectively, adapted to overlie sponge 15, and clamping portions 29 and 31, depending from upper portions 25 and 27, respectively, engageable with a respective front or back of the sponge. Upper portions 25 and 27 of the jaws are formed of plates which have front edges 33 and 35 and rear edges 37 and 39, respectively. The side edges 41 of front jaw plate 25 are substantially parallel. Rear jaw plate 27 has reverse flanges or guides 43 on its lower side along its side edges forming guideways for slidably receiving side edges 41 of front jaw plate 25 (see FIG.

8). Thus, the jaws' upper portions 25 and 27 are formed for sliding interengagement with one another to permit the jaws to be slidably moved between an open position in which their clamping portions 29 and 31 are spaced relatively far apart, as suggested in FIG. 5, for placement of sponge 15 between the jaws, and a closed position in which the clamping portions are closer together, as shown in FIG. 6, for clamping the sponge therebetween.

Clamping portions 29 and 31 of the two jaws comprise first planar rectangular sections 45 and 47 extending downwardly from outer edges 33 and 39 of plates 25 and 27 and inclined toward opposite edges 37 and 35. The clamping portions also have second planar rectangular sections 49 and 51 extending horizontally outwardly from the lower edges of the inclined sections 45 and 47 generally parallel to the plane of plates 25 and 27. Relatively small integrally-formed stiffening gussets 53 are provided at the intersection of the inclined and horizontal sections of the clamping portions of the jaws. Flanges 55 extending along the side edges of the sections and flanges 56 at the edges of the horizontal sections are provided for reinforcement.

A pair of spring clips 57 are mounted on the rear jaw upper portion 27 and extend in front-to-back direction with respect thereto. Beyond forward edge 35, each clip has a downwardly-rolled front end 59 engageable with the outer side of the inclined section 45 of the front jaw when the jaws are in their closed position (see FIG. 6). The clips hold the jaws closed to compress and thereby clamp a sponge between the jaws. As shown in FIG. 5, ramps 61 for the spring clips are provided in front jaw plate 25 for preventing interference between the clips and the rear edge 37 of the front jaw when the jaws are slid together.

Figure 3:
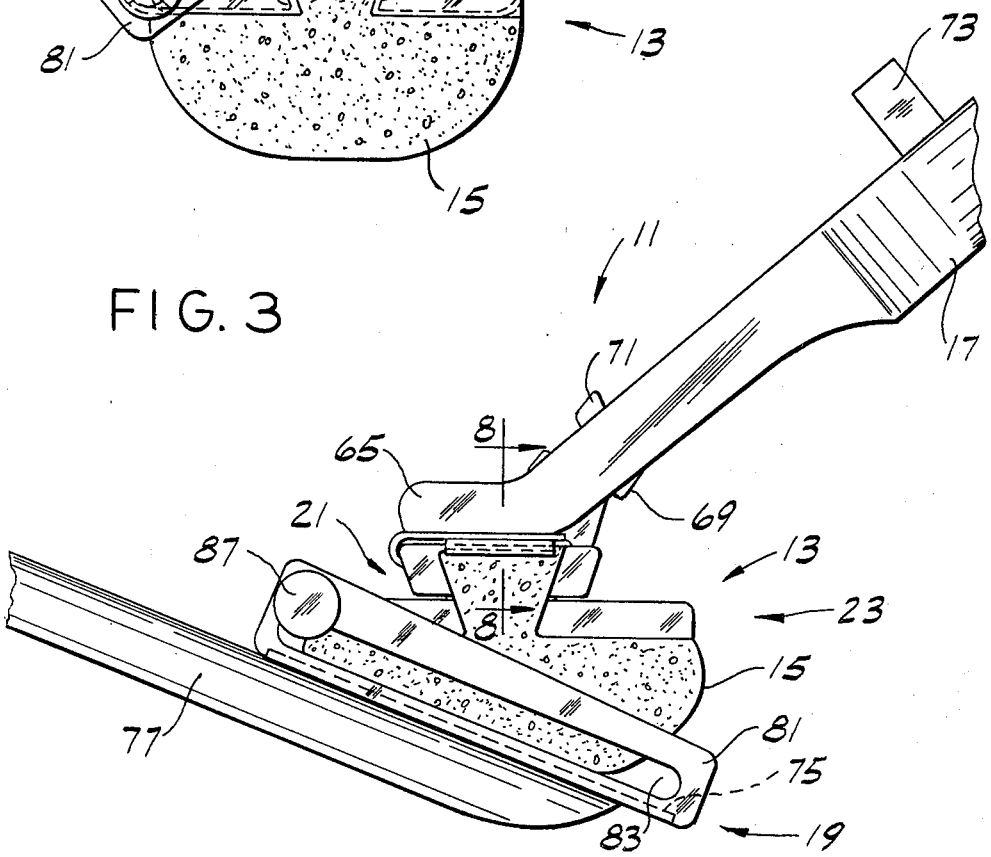
FIG. 3 is an elevation similar to FIGS. 1 and 2 with the wringer pivoted from the extended position of FIG. 2 to a wringing position.
Figure 2:
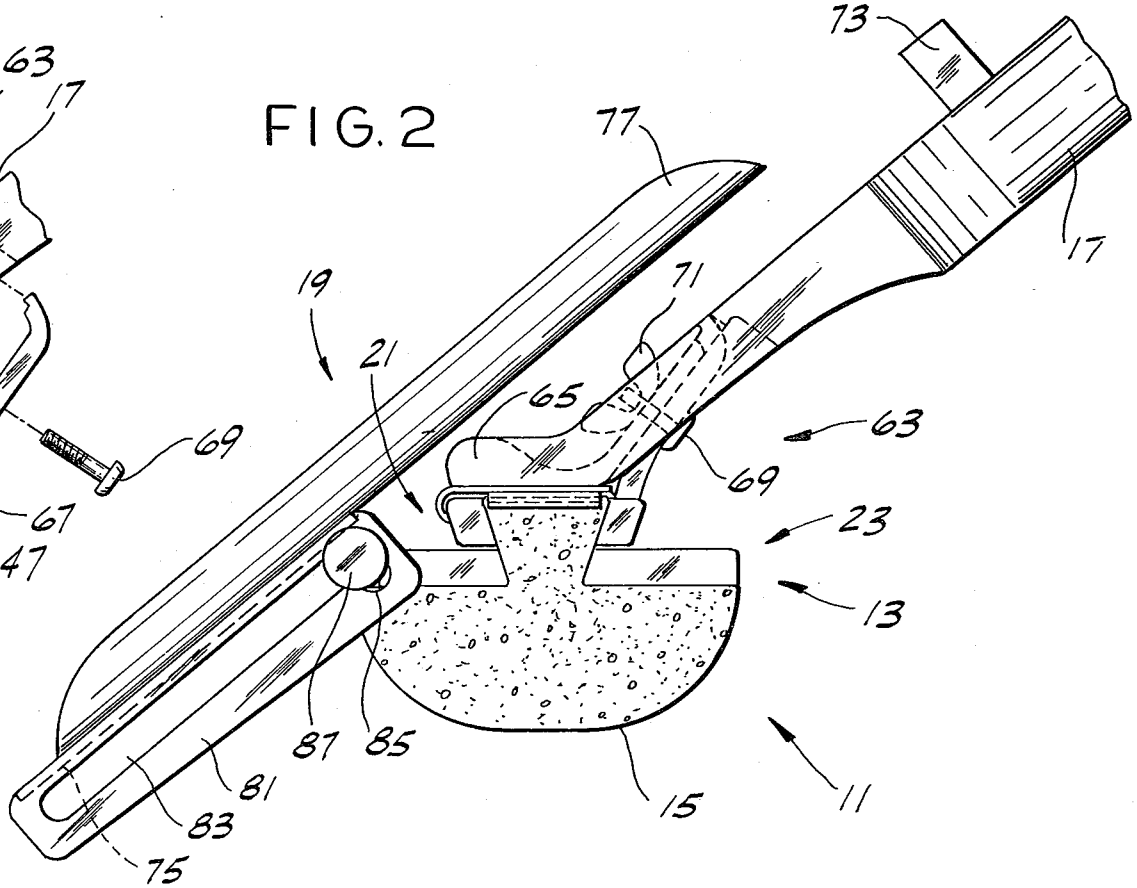
FIG. 2 is an elevation similar to FIG. 1 with the wringer slid to an extended position.
Figure 4:
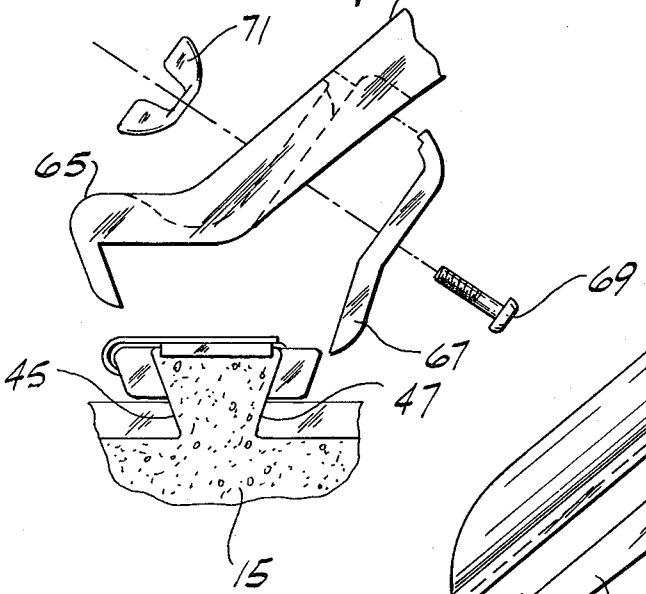
FIG. 4 is an exploded side elevation of the clamp at the lower end of the mop handle by which the handle is secured to the mop.

As best shown in FIGS. 1–4, particularly FIG. 4, mop handle 17 has a clamp 63 at its lower end adapted to clamp against inclined jaw sections 45 and 47, thereby serving to attach the handle to the mop head and aiding in holding the two jaws in closed position. The handle is mounted to project to the rear of the mop head at approximately 45° relative to vertical. As shown in FIG. 4, clamp 63 comprises a first clamping member 65 integrally formed with the handle 17 and extending downwardly therefrom along the outer side of front jaw section 45. A second clamping member 67, secured to the first member by a bolt 69 and wingnut 71, projects down along the outer side of rear jaw section 47. By tightening the wingnut on the bolt, the second clamping member is drawn toward the first clamping member for clamping the handle to the two jaws. A magnetic catch 73 is mounted on the forward side of the handle for securing wringer 19 in a retracted position, as described below.

Wringer 19 is mounted at the front of the mop head on horizontal section 49 of the front jaw. As shown in FIG. 5, the wringer comprises a substantially planar rectangular squeeze plate 75 extending in side-to-side direction with respect to the mop head and a lever arm 77 attached to the squeeze plate and extending rearwardly therefrom. The squeeze plate has holes 79 to permit escape of water squeezed from the sponge. A pair of relatively narrow substantially parallel flanges 81 at opposite sides of the squeeze plate extend in front-to-back direction with respect to the squeeze plate and mop head. The flanges have two substantially parallel longitudinal slots 83 therein, each of which is substantially straight and enlarged at one end, as indicated at 85. Flanges 86 are provided at the front and rear of the squeeze plate for reinforcement.

A pair of pivot pins 87 extend laterally outwardly beyond opposite sides of the front jaw 21 and are received in slots 83 in squeeze plate flanges 81 for mounting the wringer on the mop head. These pins 87 are threaded into tubes 89 at the outer forward corners of front jaw section 49 (see FIG. 8), the tubes being spot-welded to extensions 91 of jaw section 49 which are rolled over the tubes. Each pin is in the form of a screw having a knurled head 93 and an unthreaded cylindrical support portion 95 which rides in a respective slot 83.

When the mop is used for mopping, the wringer is ordinarily fixed in a retracted position, as shown in FIG. 1, with lever arm 77 projected upward along the forward side of mop handle 17 and with pivot pins 87 located at the lower ends of flange slots 83. Magnetic catch 73 on the mop handle secures the wringer's lever arm to the mop handle, holding the wringer in the retracted position in which it is clear of the sponge, to permit mopping. When the wringer is to be used for squeezing water (and dirt) out of the sponge, the lever arm is disengaged from the magnetic catch and the wringer is slid downwardly relative to the mop head to an extended portion (FIG. 2) in which the pivot pins 87 are in the enlarged upper ends 85 of the slots. The wringer is then pivoted on the pivot pins by moving the lever arm forward away from the mop handle, continuing until the squeeze plate contacts and squeezes the sponge, as shown in FIG. 3. The wringer is pivoted through less than 150° to effect the squeezing. When the sponge is wrung out, the wringer is pivoted back to the extended position (see FIG. 2) and then slid back to the retracted position and secured by the magnetic catch (FIG. 1). Thus, pivot pins 87 and slotted flanges 81 constitute means for mounting the squeeze plate and lever arm on the mop head for sliding movement of the squeeze plate from the retracted position in which the squeeze plate is disposed out of the way to permit mopping, to the extended position. They further constitute means for permitting pivoting movement of the squeeze plate, via the lever arm, about an axis extending in side-to-side direction with respect to the mop head, from the extended position to the wringing position in which the squeeze plate squeezes the sponge to wring it out.

A principal advantage of this invention lies in this improved wringer. The angle through which the wringer must be rotated to effect wringing of the sponge is minimized, being less than 150° in the embodiment shown, to make the step of wringing less awkward than is the case with conventional mops. The wringer is retracted far out of the way when not in use.

Another advantage of the invention is its capability of utilizing an ordinary relatively inexpensive household sponge as a replacement. Replacement of the sponge is relatively simple: wingnut 71 of clamp 63 is loosened and the mop handle is disconnected from the mop head. Then the spring clips 57 are released and the two jaws slid apart, as in FIG. 5, so that the old sponge can be removed. When the new sponge is in place, the two jaws are slid together until the spring clips snap behind the inclined section 45 of the front jaw. Finally, the mop handle is reclamped to the mop head by tightening wingnut 71.

Figure 11:
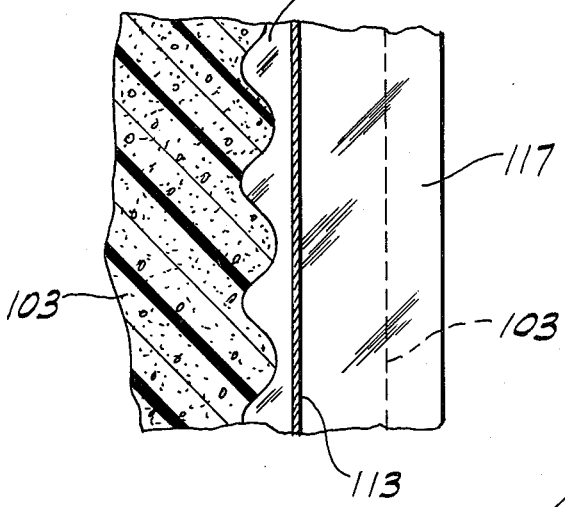
FIG. 11 is a section taken along line 11—11 of FIG. 9 illustrating teeth in the mop head jaws.
Figure 9:
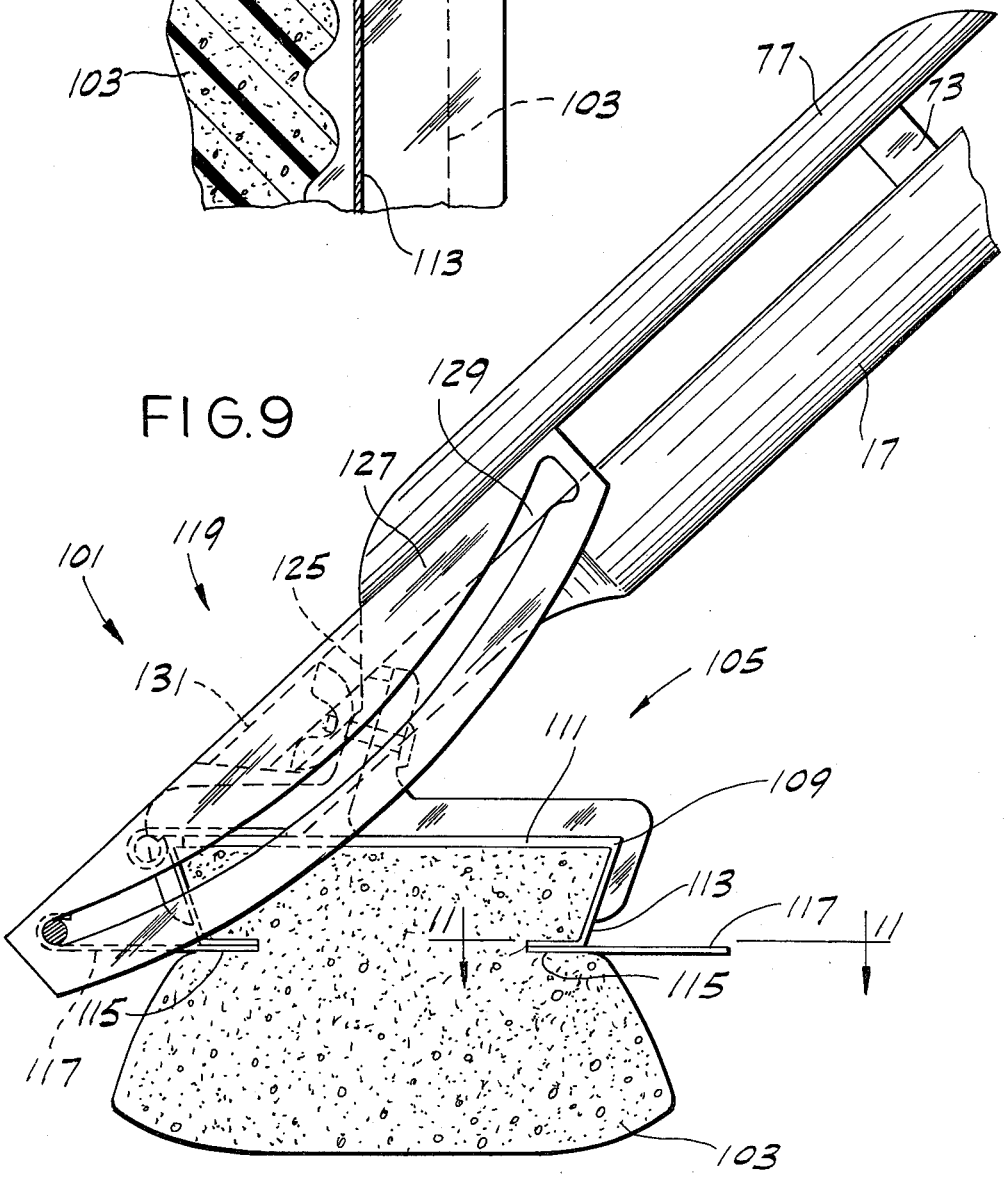
FIG. 9 is a side elevation of an alternate embodiment of the invention showing the mop wringer in its retracted position.
Figure 10:
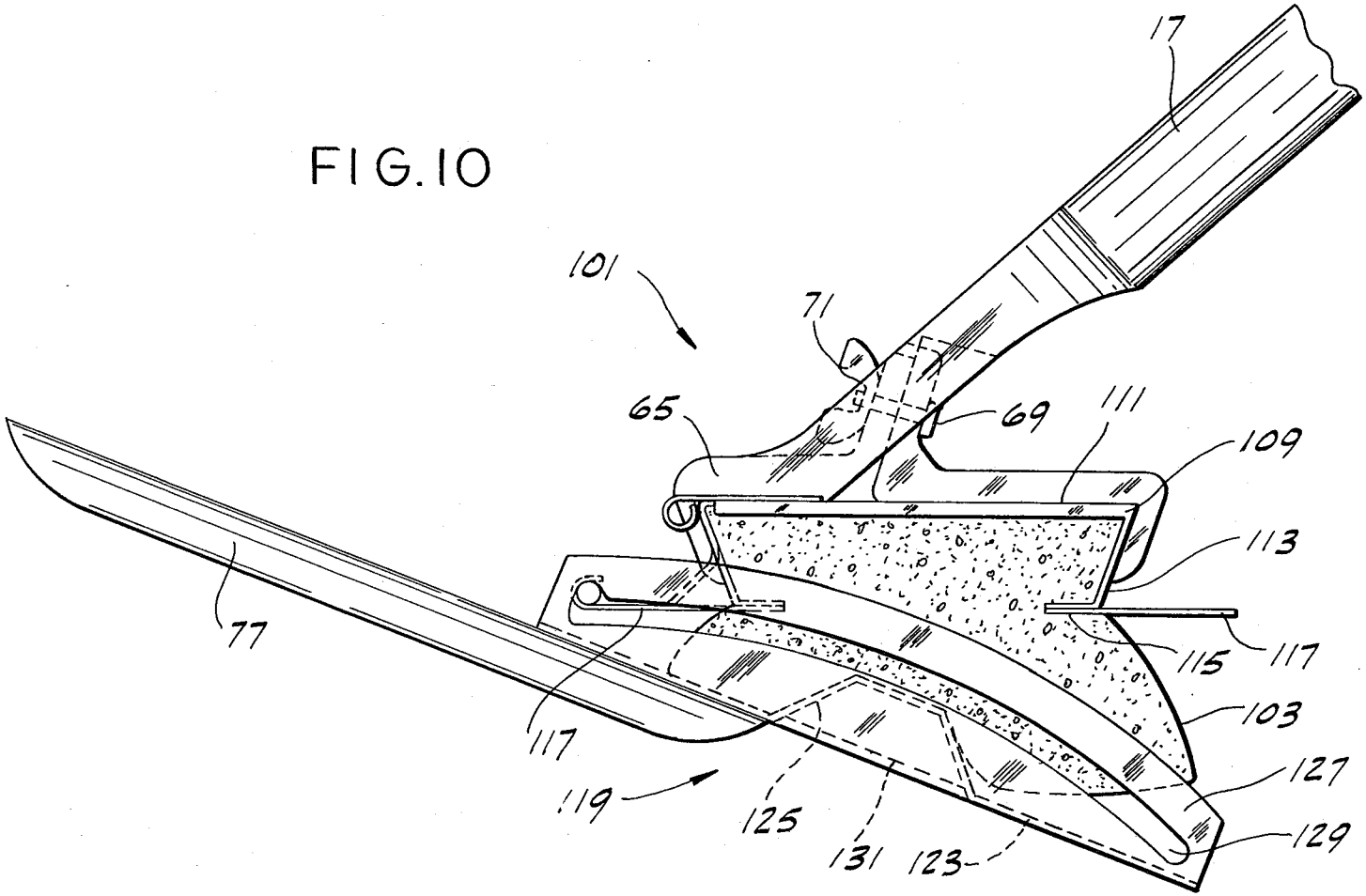
FIG. 10 is a side elevation of the embodiment of FIG. 9 showing the wringer in its wringing position.

The alternate embodiment of the invention shown in FIGS. 9–11, generally designated 101, is especially adapted for use with a relatively stiff sponge 103. Many parts of the mop are substantially the same as the previously-described embodiment and such parts are designated by the same reference numerals. The mop head 105 comprises front and rear jaws 107 and 109 having upper portions 111 which are slidably interengageable in the manner described above. The jaws also have depending clamping portions generally formed of a section 113 inclined downward and inward. The bottom edge of inclined section 113 of each clamping portion is formed with teeth 115 which bite into sponge 103, as shown in FIG. 11. The clamping portions of the jaws include horizontal sections 117 extending outwardly from the lower ends of inclined sections 113. The wringer 119 is mounted on horizontal section 117 of the front jaw in the same fashion as the previous embodiment.

The mop's wringer includes a squeeze plate 123 having a longitudinal corrugation 125 extending from one side of the squeeze plate to the other and projecting to that side of the plate which contacts the sponge when the plate is swung to wring out the sponge. The corrugation squeezes the sponge deeply inward to better wring it out. In order for the corrugation to clear the forward edge of the upper portion 111 of the front jaw when the wringer is slid from its retracted (FIG. 9) position to its extended (FIG. 10) position, slots 129 in flanges 127 are curved along arcs projecting to the same side of the squeeze plate as corrugation 125. The flanges are correspondingly enlarged to accommodate the arcuate slots. The corrugation has a recessed portion 131 at its longitudinal center to accommodate wingnut 71 when the wringer is in its retracted position.

The alternate embodiment of FIGS. 9–11 is utilized in substantially the same manner as the embodiment of FIGS. 1–8. As stated above, it is especially suited for use with relatively stiff sponges.

In view of the above, it will be seen that the several objects of the invention are achieved and other advantageous results attained.

As various changes could be made in the above constructions without departing from the scope of the invention, it is intended that all matter contained in the above description shown in the accompanying drawings shall be interpreted as illustrative and not in a limiting sense.

What is claimed is:

1. A mop comprising a mop head having opposing front and back jaws for clamping a sponge or the like therebetween, each jaw having an upper portion adapted to overlie the sponge and a depending clamping portion engageable with a respective front or back of the sponge, the upper portions of the jaws being formed for sliding interengagement with one another thereby to permit the jaws to be slidably moved between an open position in which their clamping portions are spaced relatively far apart for placement of a sponge therebetween and a closed position in which the clamping portions are closer together for clamping the sponge therebetween, and means for holding the two jaws in said closed position with the sponge clamped therebetween, said holding means comprising a spring clip mounted on the upper portion of one jaw for engagement with the clamping portion of the other jaw when the jaws are in said closed position to hold the two jaws closed.

2. A mop comprising a mop head having opposing front and back jaws for clamping a sponge or the like therebetween, each jaw having an upper portion adapted to overlie the sponge and a depending clamping portion engageable with a respective front or back of the sponge, the upper portions of the jaws being formed for sliding interengagement with one another thereby to permit the jaws to be slidably moved between an open position in which their clamping portions are spaced relatively far apart for placement of a sponge therebetween and a closed position in which the clamping portions are closer together for clamping the sponge therebetween, means for holding the two jaws in said closed position with the sponge clamped therebetween, and a mop handle, said holding means comprising a clamp at the lower end of the handle adapted to clamp against the clamping portions of the two jaws and to hold them in said closed position, the clamp also serving to attach the handle to the mop head.

3. A mop as set forth in claim 2 wherein the clamp comprises a first clamping member fixed to the handle and a second clamping member secured to the first member by a nut and bolt assembly, the second clamping member being adapted to be drawn toward the first clamping member for clamping the jaws in said closed position by tightening the nut on the bolt.

4. A mop comprising a mop head having opposing front and back jaws for clamping a sponge or the like therebetween, each jaw having an upper portion adapted to overlie the sponge and a depending clamping portion engageable with a respective front or back of the sponge, the upper portions of the jaws being formed for sliding interengagement with one another thereby to permit the jaws to be slidably moved between an open position in which their clamping portions are spaced relatively far apart for placement of a sponge therebetween and a closed position in which the clamping portions are closer together for clamping the sponge therebetween, means for holding the two jaws in said closed position with the sponge clamped therebetween, and a wringer mounted on the mop head.

5. A mop as set forth in claim 4 wherein the clamping portion of each jaw comprises a first section extending downwardly from the upper portion of the jaw and a second section extending outwardly from the bottom of the first section, the wringer being mounted on the second section of one of the jaws.

6. A mop as set forth in claim 4 wherein the wringer comprises a squeeze plate extending in side-to-side direction with respect to the mop head and a lever arm on the squeeze plate, and means for mounting the squeeze plate and lever arm on the mop head for (1) sliding movement of the squeeze plate from a retracted position in which it is disposed to permit mopping, to an extended position, and (2) pivoting movement of the squeeze plate, via the lever arm, about an axis extending in side-to-side direction with respect to the mop head from said extended position to a wringing position in which the squeeze plate squeezes the sponge to wring it out.

7. A mop as set forth in claim 6 wherein said wringer is mounted on the front jaw of the mop head and said mounting means comprises a pair of pivot pins extending laterally outwardly beyond opposite sides of the front jaw, and a pair of relatively narrow substantially parallel flanges at opposite sides of the squeeze plate extending in front-to-back direction with respect to the squeeze plate and mop head, the flanges having two substantially parallel longitudinal slots therein for receiving said pivot pin.

8. A mop as set forth in claim 7 wherein the clamping portion of each jaw comprises a first section extending downwardly from the upper portion of the jaw and a second section extending outwardly from the bottom of the first section, said pins being mounted on the second section of the front jaw.

9. A mop as set forth in claim 4 wherein the clamping portions of the jaws have inwardly directed teeth for biting into the sponge.

10. A mop comprising a mop head for holding a sponge or the like, a wringer for wringing the sponge comprising a squeeze plate extending in side-to-side direction with respect to the mop head and a lever arm on the squeeze plate, and means for mounting the squeeze plate and lever arm on the mop head for (1) sliding movement of the squeeze plate from a retracted position in which it is disposed to permit mopping, to an extended position, and (2) pivoting movement of the squeeze plate, via the lever arm, about an axis extending in side-to-side direction with respect to the mop head from said extended position to a wringing position in which the squeeze plate squeezes the sponge to wring it out.

11. A mop as set forth in claim 10 further comprising a mop handle, the mop head being mounted at the lower end of the mop handle.

12. A mop as set forth in claim 11 further comprising means for securing the lever arm to the handle for holding the squeeze plate in its retracted position.

13. A mop as set forth in claim 11 wherein the handle projects to the rear of the mop head and the wringer mounting means is on the front of the mop head.

14. A mop as set forth in claim 10 wherein the wringer mounting means comprises a pair of pivot pins mounted on the mop head and extending laterally outwardly beyond opposite sides thereof, and a pair of relatively narrow substantially parallel flanges at opposite sides of the squeeze plate extending in front-to-back direction with respect to the squeeze plate and mop head, the flanges having two substantially parallel longitudinal slots therein for receiving the pivot pins.

15. A mop as set forth in claim 14 wherein each pivot pin comprises a screw threaded into the mop head.

16. A mop as set forth in claim 14 wherein one end of each longitudinal slot is enlarged to retain its respective pivot pin at that end of the slot as the squeeze plate is swung to its wringing position.

17. A mop as set forth in claim 14 wherein each longitudinal slot is substantially straight.

18. A mop as set forth in claim 10 wherein the squeeze plate has a longitudinal corrugation extending from one side of the plate to the other and projecting to that side of the plate which contacts the sponge when the plate is swung to wring out the sponge.

19. A mop as set forth in claim 10 wherein the mop head comprises opposing front and back jaws for clamping a sponge or the like therebetween, and means for holding the two jaws together to compressively clamp the sponge.

20. A mop as set forth in claim 19 wherein each jaw has an upper portion adapted to overlie the sponge and a depending clamping portion engageable with a respective front or back of the sponge, the upper portions of the jaws being formed for sliding interengagement wth one another thereby to permit the jaws to be slidably moved between an open position in which their clamping portions are spaced relatively far apart for placement of a sponge therebetween and a closed position in which the clamping portions are closer together for compressively clamping the sponge therebetween.

* * * * *